United States Patent [19]

Kusuda et al.

[11] Patent Number: 4,989,049

[45] Date of Patent: Jan. 29, 1991

[54] MULTI-COLOR IMAGE FORMING APPARATUS

[75] Inventors: Yasuhiro Kusuda; Takafumi Tottori; Masaru Komura, all of Osaka, Japan

[73] Assignee: Minolta Camera Kabushiki Kaisha, Osaka, Japan

[21] Appl. No.: 394,157

[22] Filed: Aug. 14, 1989

Related U.S. Application Data

[63] Continuation of Ser. No. 148,423, Jan. 25, 1988, abandoned.

[30] Foreign Application Priority Data

Jan. 26, 1987 [JP] Japan ..... 62-15572
Jan. 28, 1987 [JP] Japan ..... 62-18846
Jan. 29, 1987 [JP] Japan ..... 62-21630

[51] Int. Cl.[5] ..... G03G 15/01; G03G 15/06

[52] U.S. Cl. ..... 355/326; 355/245; 355/328

[58] Field of Search ..... 355/4, 140, 300, 7, 355/14 R, 245, 266, 328, 246, 326; 430/42

[56] References Cited

U.S. PATENT DOCUMENTS 2,910,963 11/1959 Herman .
3,572,288 6/1968 Turner .
3,914,043 10/1975 McVeigh .
3,960,445 6/1976 Drawe .
3,967,891 7/1976 Rippstein .
4,346,982 8/1982 Nakajima et al. .
4,373,798 2/1983 Tsukada et al. .
4,572,102 2/1986 Yuge et al. .
4,579,443 4/1986 Abuyama et al. .
4,619,514 10/1986 Ide .
4,627,707 12/1986 Tani et al. .
4,634,259 1/1987 Oishi et al. .
4,641,602 2/1987 Kasai .
4,657,376 4/1987 Ide .
4,659,211 4/1987 Oka .
4,666,288 5/1987 Watanabe .
4,685,794 8/1987 Watanabe .
4,690,543 9/1987 Watanabe .
4,710,016 12/1987 Waatanabe .
4,720,730 1/1988 Ito .
4,728,985 3/1988 Nakashima et al. .
4,740,811 4/1988 Watanabe .
4,743,945 5/1988 Ito et al. .
4,743,946 5/1988 Nishimori et al. .
4,745,437 5/1988 Oka et al. .
4,746,954 5/1988 Matuura et al. .
4,754,301 6/1988 Kasamura et al. .
4,772,921 9/1988 Ito .
4,897,697 1/1990 Ito et al. ..... 355/245 X
4,935,781 6/1990 Ito et al. ..... 355/328 X
4,956,679 9/1990 Takano et al. ..... 355/326
4,958,190 9/1990 Ito ..... 355/326 X
4,958,192 9/1990 Kusumoto ..... 355/326 X

FOREIGN PATENT DOCUMENTS 3705511 9/1987 Fed. Rep. of Germany .
48-22212 7/1973 Japan .
51-134635 11/1976 Japan .
54-30833 3/1979 Japan .
60-170868 9/1985 Japan .
60-212778 10/1985 Japan .
61-72270 4/1986 Japan .
61-203474 9/1986 Japan .

*Primary Examiner*—A. T. Grimley
*Assistant Examiner*—Matthew S. Smith
*Attorney, Agent, or Firm*—Burns, Doane, Swecker & Mathis

[57] ABSTRACT

A multi-color image forming apparatus including an original platform, a photoreceptor, a scanning device, an image forming device for forming an electrostatic latent image on the photoreceptor, first and second developing devices for developing the latent image in different colors, respectively, a movable designating device, an input device for giving a command for starting copying, a starting device for starting operation of the scanning device, the image forming device and the first developing device in response to the command from the input device, an output device for outputting a changeover signal for effecting changeover between the first and second developing devices and a control device for, in response to the changeover signal from the output device, stopping operation of the first developing device and starting operation of the second developing device.

10 Claims, 10 Drawing Sheets

MULTI-COLOR IMAGE FORMING APPARATUS

This application is a continuation of application Ser. No. 148,423, filed Jan. 25, 1988 now abandoned.

BACKGROUND OF THE INVENTION

The present invention generally relates to an image forming apparatus such as a copying apparatus and the like, and more particularly, to a multi-color image forming apparatus having a function for reproducing an image of an original document in a plurality of colors.

Conventionally, as one type of a multi-color image forming apparatus, there has been proposed a copying apparatus in, for example, U.S. Pat. No. 3,914,043. In this known copying apparatus, there is provided at a side of an original platform of glass disposed at an upper portion of an apparatus housing, a region designating means not only for designating a plurality of regions by dividing a face of the original platform in a scanning direction of an exposure lamp but for designating reproduction colors of portions of an image of an original document located at the regions, respectively.

In the case where the image of the original document is reproduced in two colors by using this known copying apparatus, the image of the original document is initially scanned by the exposure lamp such that an electrostatic latent image is formed on a surface of a photoreceptor or photosensitive drum. Then, by leaving only an electrostatic latent image portion corresponding to a first designated region as it is, another electrostatic latent image portion corresponding to the remaining region is erased. Thereafter, the first designated region is reproduced by developer of a first designated color. Subsequently, this image of the first color is transferred onto a copy paper sheet and then, is subjected to fusion fixing in a fixing process.

Then, the image of the original document is scanned by the exposure lamp again such that the electrostatic latent image is re-formed. By leaving only an electrostatic latent image portion corresponding to a second designated region as it is, another electrostatic latent image portion corresponding to the remaining region is erased. Thereafter, the second designated region is reproduced by developer of a second designated color. This image of the second color is transferred onto the copy paper sheet bearing the image of the first color and then, is again subjected to a fixing operation so as to be discharged from the apparatus housing.

As described above, in the known copying apparatus, copying operations should be repeated times of the number identical with the number of the reproduction colors.

Thus, the known copying apparatus has such a drawback that a long time period is required for copying. Furthermore, when the image of the first color is fixed in the fixing process, the copy paper sheet is subjected to thermal shrinkage by high temperature and timing of the first feed of the leading edge of the copy paper sheet to the transfer zone deviates from that of the second feed, such a problem arises that an improper image is formed through overlap between the image of the first color and the image of the second color or formation of blank portions therebetween.

SUMMARY OF THE INVENTION

The present invention provides a multi-color image forming apparatus comprising: an original platform; a photoreceptor; a scanning means for scanning from a scanning start position towards a scanning completion position an original document placed on said original platform; an image forming means which projects an image of the original document scanned by said scanning means, onto said photoreceptor so as to form an electrostatic latent image on said photoreceptor; first and second developing means for developing the electrostatic latent image in different colors, respectively; a designating means which is movable, in a direction of scanning of said scanning means along said original platform, at least between the scanning start position and the scanning completion position; an input means for giving a command for starting copying of said multi-color image forming apparatus; a starting means for starting operation of said scanning means, said image forming means and said first developing means in response to the command from said input means an output means which detects that said scanning means has reached, during scanning of said scanning means, a position corresponding to said designating means so as to output a changeover signal for effecting changeover between said first developing means and said second developing means; and a control means which, in response to the changeover signal from said output means, not only stops operation of said first developing means but starts operation of said second developing means.

BRIEF DESCRIPTION OF THE DRAWINGS

Features of the present invention will become apparent from the following description taken in conjunction with the preferred embodiment thereof with reference to the accompanying drawings, in which.

DETAILED DESCRIPTION OF THE INVENTION

Figure 1:
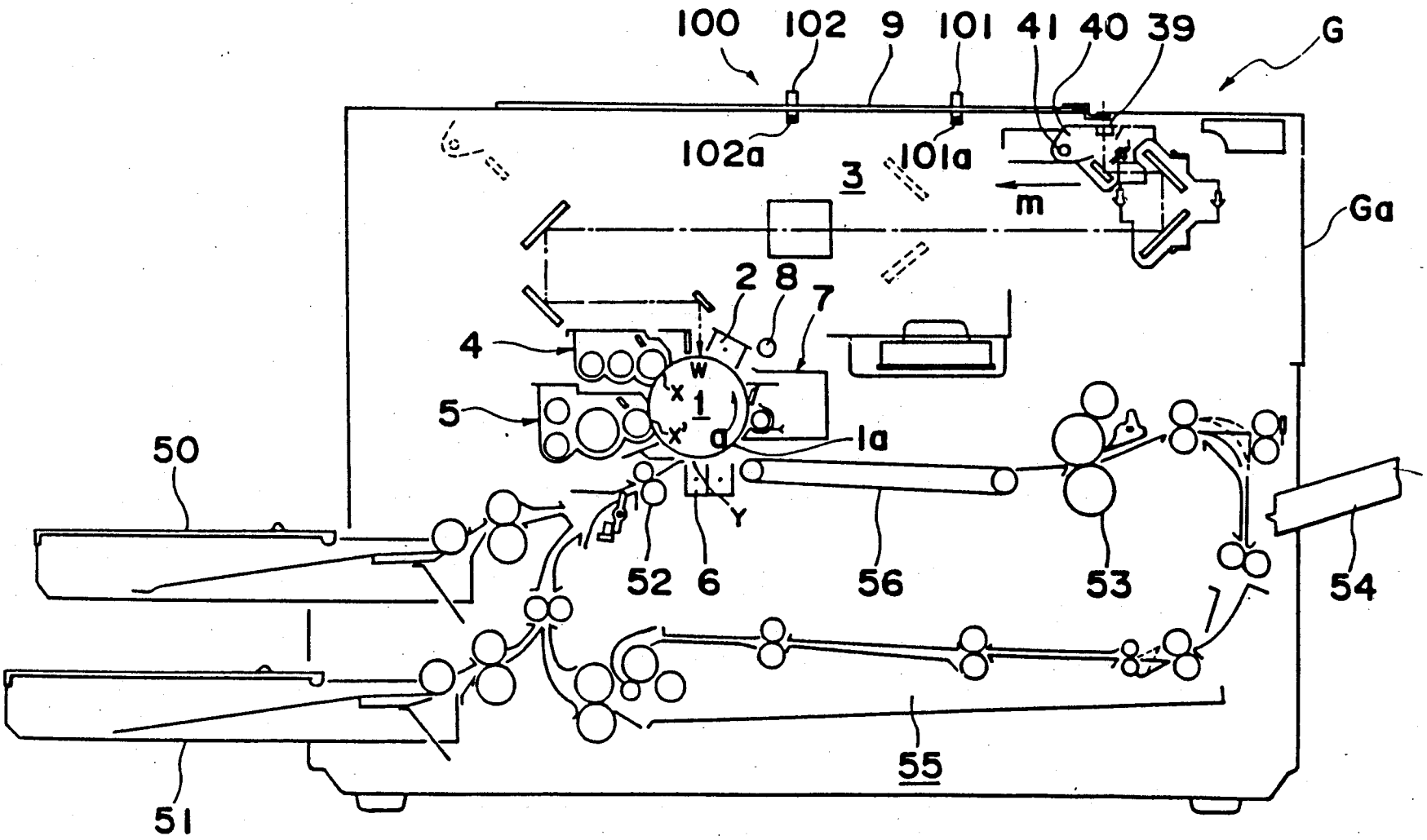
FIG. 1 is a schematic sectional view of a multi-color image forming apparatus according to one preferred embodiment of the present invention.

Before the description of the present invention proceeds, it is to be noted that like parts are designated by like reference numerals throughout the accompanying drawings.

Referring now to the drawings, there is shown in FIG. 1 a multi-color image forming apparatus in the form of a two-color copying apparatus G to which the present invention may be applied, the general construction of which will be described hereinbelow together with the standard copying operation for reproducing an image of an original document as it is.

In FIG. 1, the two-color copying apparatus G generally includes a photosensitive or photoreceptor drum 1 having a photosensitive surface 1*a* on its outer periphery and rotatably disposed generally at a central portion of an apparatus housing Ga for rotation in a direction indicated by an arrow a, and various processing stations such as a corona charger 2, a first developing unit 4 and a second developing unit 5, a transfer charger 6, a cleaning device 7 and an eraser lamp 8, etc. sequentially disposed around the photoreceptor drum 1 as shown.

In the state where the photoreceptor drum 1 is rotating in the direction of the arrow a, the photosensitive surface 1*a* of the photoreceptor drum 1 is charged with a predetermined amount of electrical charge through discharge by the corona charger 2.

Subsequently, a scanner 40 of an optical system 3 having an exposure lamp 41 is movably provided below and adjacent to a transparent original document platform 9 of a glass material or the like disposed at the upper portion of the housing Ga and projects light onto an original document (not shown) placed on said platform 9, while performing the scanning function in the direction of an arrow m, i.e. in the direction oriented from a scanning start position shown by the solid lines towards a scanning completion position shown by the dotted lines. Then, the light reflected from the original document is projected onto the photosensitive surface 1*a* of the photoreceptor drum 1 via reflecting mirrors and a lens assembly through an exposure point W, and thus, an electrostatic latent image corresponding to the image of the original document is formed on said surface 1*a*.

The electrostatic latent image thus formed is developed into a visible toner image at a developing region X or X' corresponding in position to the first developing unit 4 or second developing unit 5 as the photoreceptor drum 1 rotates, thereby forming the toner image which is the reproduction of the original document image.

Meanwhile, the copy paper sheet is supplied selectively from a paper feeding section 50 or 51 provided at the lower left portion of the apparatus housing Ga in FIG. 1, and is transported to a portion confronting the transfer charger 6 (i.e., a transfer region Y) in timed relation with respect to the toner image formed on the photoreceptor drum 1. After the toner image has been transferred onto the copy paper sheet, the copy paper sheet is transported in between a pair of fixing rollers 53 through a transport belt 56 movably supported by rollers so that the toner image is fixed thereon by heat fusion of toner, and is then discharged onto a discharge tray 54.

However, if a duplex or opposite side copying mode has been selected, the copy paper sheet is transported into a duplex device 55 so as to be turned over in its front and reverse faces thereat, and then, again transported to the transfer region Y, while at the optical system 3 and around the photoreceptor drum 1, a second copying operation is performed in the similar manner as before so as to form the image on the reverse face of the copy paper sheet this time.

The toner remaining on the photosensitive surface 1*a* of the photoreceptor drum 1 is scraped off therefrom by the cleaning device 7, and further, residual charge thereon is also erased through irradiation of light by the eraser lamp 8 in preparation for subsequent development.

In addition to the standard copying as described so far, the copying apparatus G is capable of effecting a function to obtain a composite copy in two colors by subjecting the scanner 40 to one scanning function (referred to as "simultaneous color copying" hereinafter). For this purpose, an image editing mechanism 100 is added and special mechanisms are, respectively, provided for the developing units 4 and 5.

In the first place, the developing units 4 and 5 will be explained hereinafter.

Figure 2:
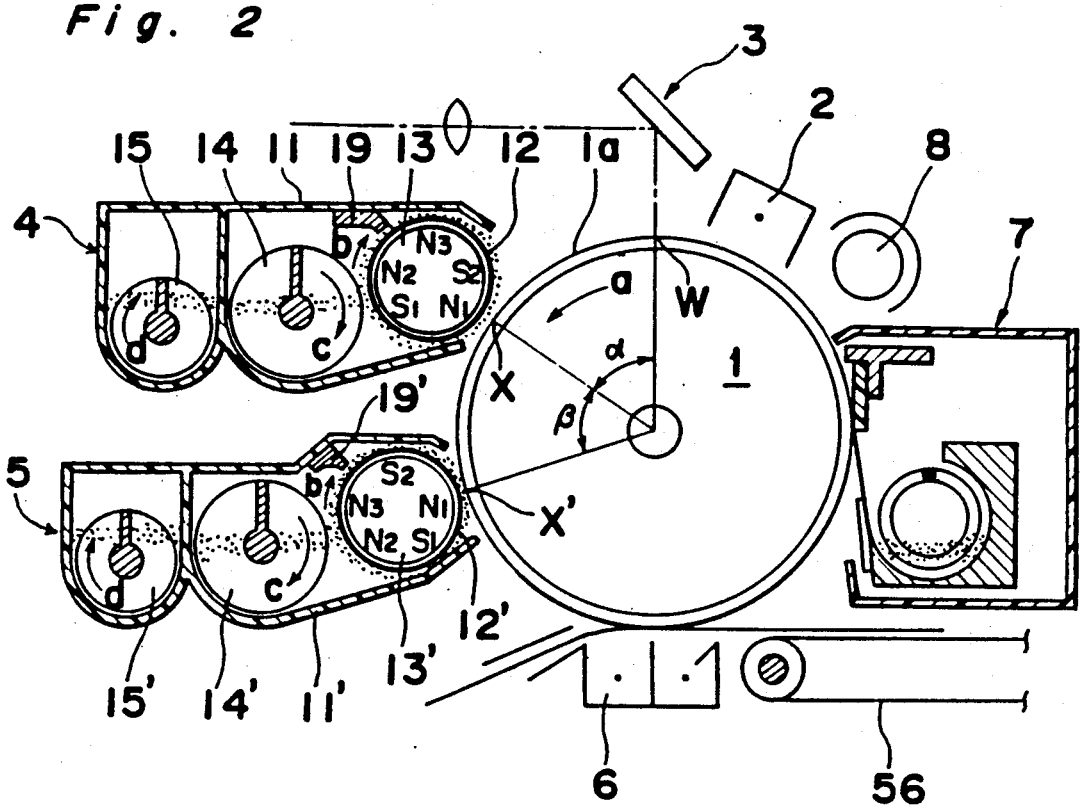
FIG. 2 is a fragmentary sectional view showing, on an enlarged scale, a photoreceptor drum and devices provided therearound in the apparatus of FIG. 1.
Figure 3:
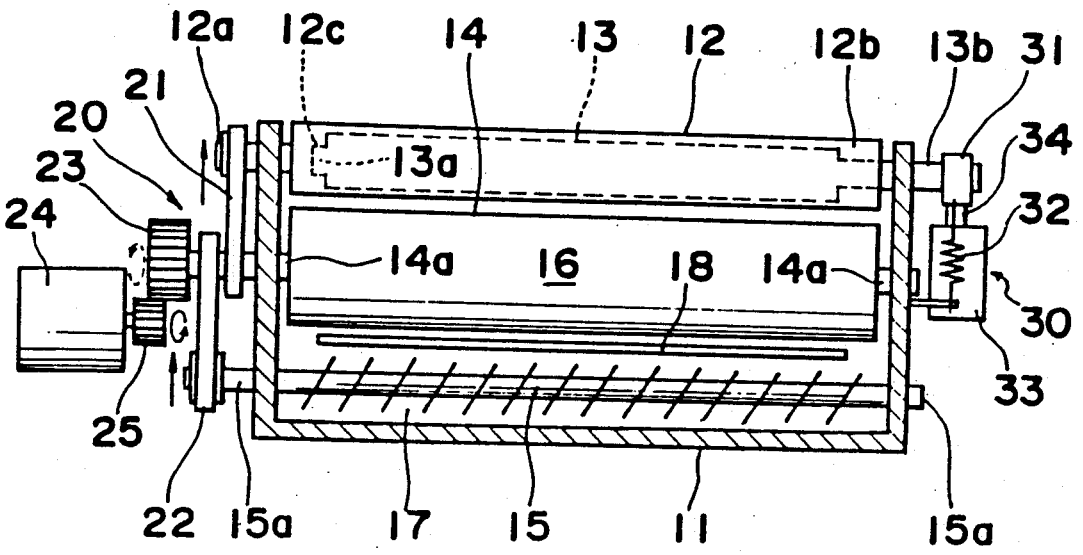
FIG. 3 is a longitudinal sectional view showing, on a still enlarged scale, a developing unit employed in the apparatus of FIG. 1.
Figure 4:
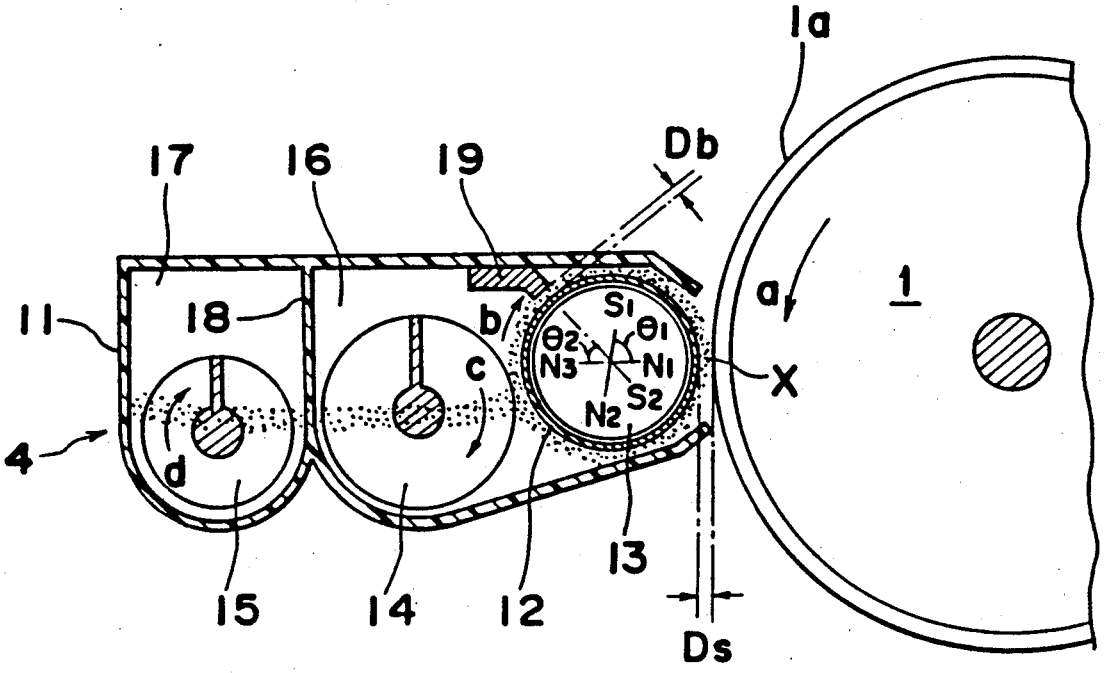
FIGS. 4 and 6 are transverse sectional views of the developing unit showing relation thereof with respect to the photoreceptor drum.

Referring particularly to FIGS. 2 to 4, each of the developing units 4 and 5 having construction generally equal to each other includes a developing tank 11 open at its one edge adjacent to the photosensitive surface 1*a* of the photoreceptor drum 1, and a developing sleeve 12, a supply roller 14 and a screw 15 rotatably provided within said developing tank in that order sequentially from the side of the photoreceptor drum 1. The first developing device 4 contains a developer composed of magnetic carrier and insulating color toner, while the second developing unit 5 contains a developer composed of magnetic carrier and insulating black toner in common use.

The developing sleeve 12 made of a non-magnetic electrically conductive material formed into a cylindrical shape of 24.5 mm in diameter is formed with very small concave and convex portions or undulations on its outer peripheral surface by sand blast processing, and confronts the photosensitive surface 1*a* of the photoreceptor drum 1 at the developing region X or X' through a developing gap Ds (=0.6 mm), with rotational angles from the exposure point W to the developing regions X and X' being respectively set as $\alpha$ and $(\alpha+\beta)$, wherein $\alpha$ is set at 56° and $\beta$ at 52°.

Meanwhile, at the back face side of the developing sleeve 12 with respect to the developing region X, a magnetic brush bristle height restricting plate 19 is provided at an upper inner portion of the developing tank 11 so as to confront the surface of said developing sleeve 12 through a bristle height restricting gap Db (=0.4 mm).

Within the developing sleeve 12, there is disposed a magnet roller 13 having a plurality of magnets extending in the axial direction, and magnetic forces of magnetic poles N1, N2 and N3, and S1 and S2 located at outer peripheral faces of such magnets are respectively set as N1=1000 G, N2 and N3=500 G, and S1 and S2=800 G (G is an abbreviation of a unit gauss).

As shown in FIG. 4, the center of the magnetic pole N1 is located at a position displaced clockwise from the center of the magnetic pole S1 by $\theta$ (80°), while the center of the magnetic pole N3 is adapted to be located at a position displaced counterclockwise from the portion confronting the bristle height restricting member 19 by $\theta 2$ (40°), under the state where the magnetic pole N1 faces the surface 1*a* of the photoreceptor drum 1.

As is seen from FIG. 3, the magnet roller 13 has one end 13*a* of its shaft supported in a bearing recess 12*c* formed in the developing sleeve 12, and the other end 13*b* thereof supported by a side wall of the developing tank 11, so as to be rotatable through a predetermined angle ($\theta 1 = 40°$) by a displacing means to be described in detail hereinbelow.

Meanwhile, the developing sleeve 12 has its bearing portion 12*b* at the right side in FIG. 3 supported by the shaft 13*b* of the magnet roller 13, with its shaft 12*a* at the left side being supported by the side wall of the developing tank 11, so as to be driven for rotation by a driving means 20.

The supply roller 14 and the screw 15 are respectively disposed in transport passages 16 and 17 formed in the developing tank 11 by a partitioning wall 18 (FIG. 4), and rotatably supported through support shafts 14*a* and 15*a* thereof (FIG. 3) by the corresponding side walls of the developing tank 11 so as to be driven for rotation by the driving means 20.

It is to be noted here that the transport passages 16 and 17 are communicated with each other at the opposite sides of the developing tank 11 as shown in FIG. 3.

Subsequently, the driving means 20 for the developing units 4 and 5, the supply roller 14 and the screw 15 will be described.

Still referring to FIG. 3, a belt 21 is passed around the shaft 12*a* of the developing sleeve 12 and the shaft 14*a* of the supply roller 14, while another belt 22 is directed around the shaft 14*a* of the supply roller 14 and the shaft 15*a* of the screw 15. Meanwhile, a gear 23 is mounted on the end of the shaft 14*a* of the supply roller 14, and the gear 23 is engaged with a driving gear 25 of the motor 24.

Accordingly, when the driving gear 25 is rotated in a direction indicated by a solid line arrow, the gear 23 and the belts 21 and 22 are turned in the direction shown by a dotted line arrow, and thus, the developing sleeve 12, supply roller 14 and screw 15 are respectively rotated in directions shown by arrows b, c and d in FIG. 2. It is to be noted here that the developing sleeve 12 is arranged to be rotated at 240 rpm in this embodiment.

Figure 5:
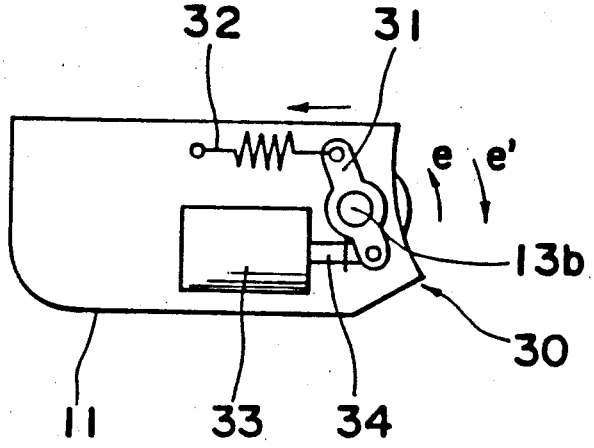
FIGS. 5 and 7 are side elevational views of a moving means employed for the developing unit.
Figure 7:
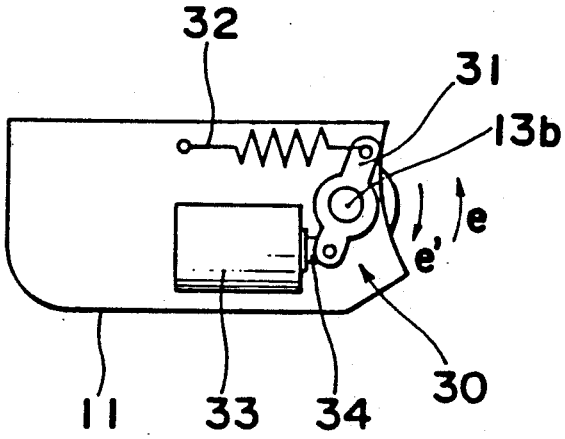

As shown in FIGS. 5 and 7, a displacing means 30 of the magnet roller 13 is constituted by a lever 31, a spring 32 and a solenoid 33. The lever 31 is fixed to the end of the shaft 13*b* for the magnet roller 13, and to one end of said lever 31, corresponding one end of the spring 32 fixed to the developing tank 11 is connected so as to normally urge the lever 31 in a direction indicated by an arrow e. Meanwhile, to the other end of the lever 31, a plunger 34 of the solenoid 33 is connected, so that upon driving of the solenoid 33, the lever 31 is rotated in the direction of an arrow e' against the urging force of the spring 32.

When the solenoid 33 is not functioning, i.e., when the lever 31 is in the state as illustrated in FIG. 5, the magnetic pole N1 of the magnet roller 13 confronts the photoreceptor drum 1, while the magnetic pole N3 is retreated at a position displaced counterclockwise by $\theta 2$ (40°) from the confronting portion with respect to the bristle height restricting member 19 as shown in FIG. 4.

Figure 6:
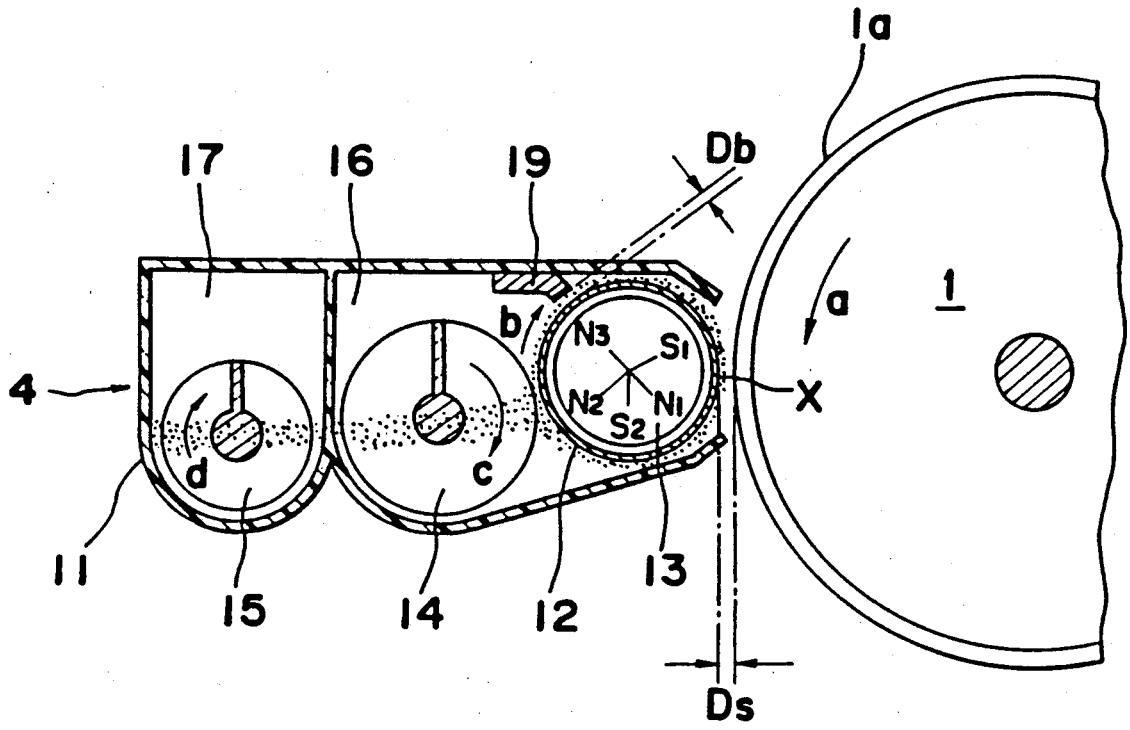

On the contrary, when the solenoid 33 is driven and the lever 31 is in the state as illustrated in FIG. 7, the magnetic pole N3 confronts the bristle height restricting member 19, while a portion intermediate between the magnetic pole N1 and the magnetic pole S1 faces the photoreceptor drum 1 (FIG. 6).

Hereinafter, the image editing mechanism 100 will be described.

Figure 8:
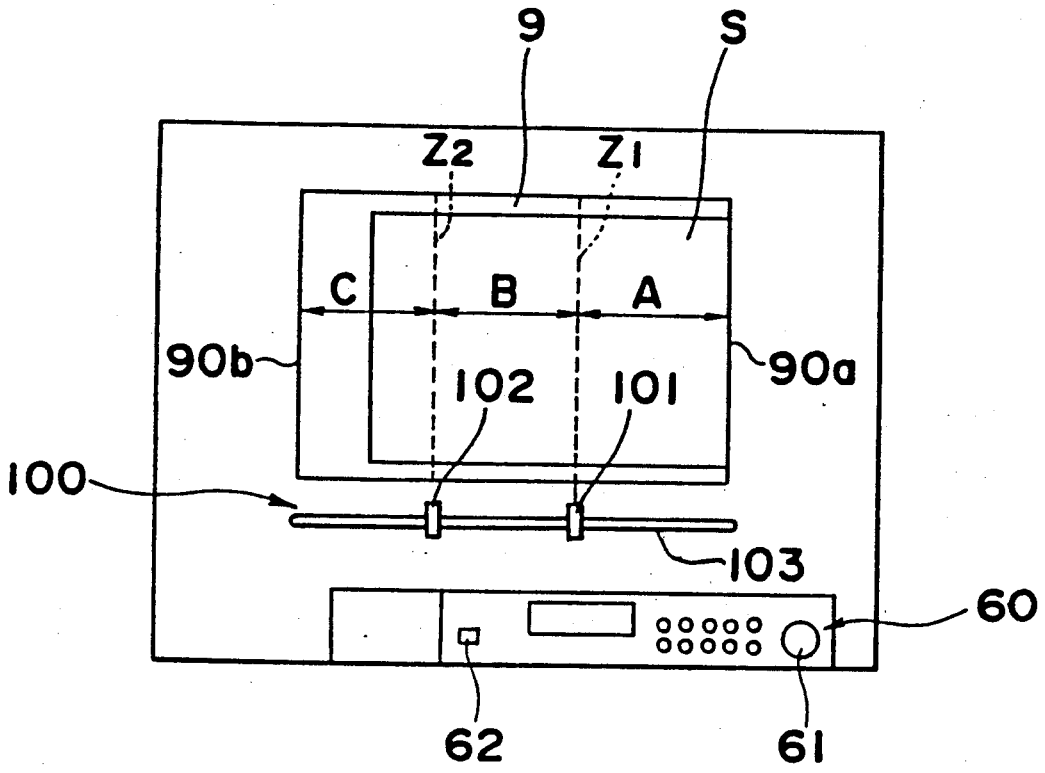
FIG. 8 is a top plan view of an image editing mechanism employed in the apparatus of FIG. 1.
Figure 9:
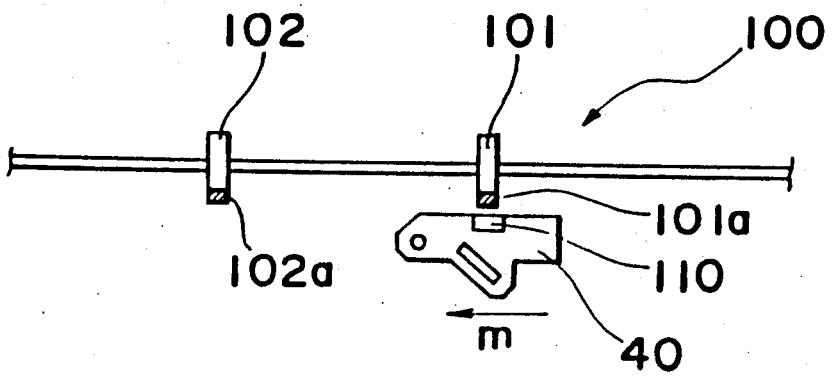
FIG. 9 is a sectional view of the image editing mechanism of FIG. 8.

In FIGS. 8 and 9, first and second levers 101 and 102 of the image editing mechanism 100 are arranged to designate regions by dividing the original document placing surface of the transparent original document platform 9 in the moving direction of the scanner 40 (in a direction indicated by an arrow m), with simultaneous designation of the reproducing color, and are slidably fitted in a guide groove 103 formed in the scanning direction of the scanner 40 at the side portion of the original document platform 9, while, within the apparatus housing Ga, in positions under the levers 101 and 102, there are respectively provided magnets 101*a* and 102*a*.

Thus, as illustrated in FIG. 8, in the state where the respective levers 101 and 102 are set, regions are designated in such a manner that the position from the forward edge 90*a* of the original document platform 9 to the first lever 101 is a region A, the portion from the first lever 101 to the second lever 102 is a region B, and the portion from the second lever 102 to the rear edge 90*b* of the platform 9 is a region C, while the regions A and C are designated as white and black, with the region B being designated as color.

Figure 10:
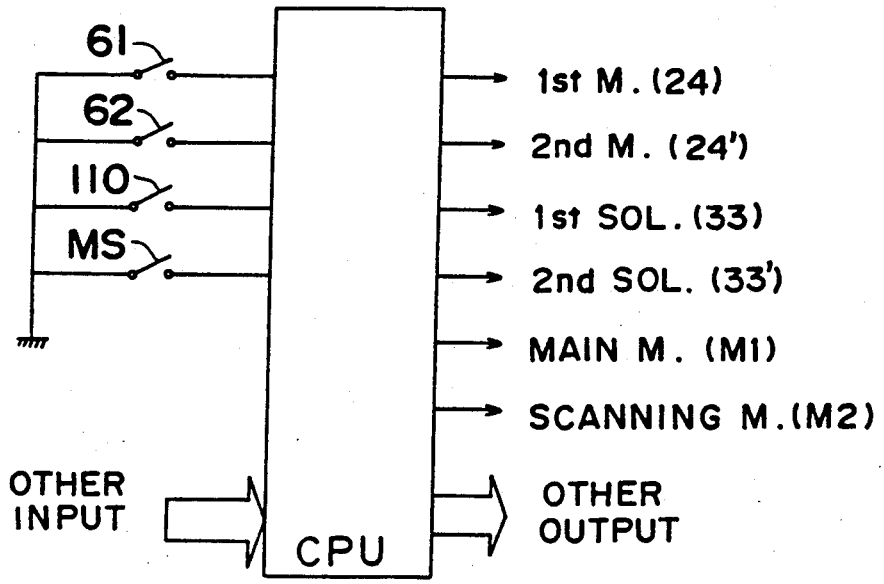
FIG. 10 is a circuit diagram of the apparatus of FIG. 1.

On the other hand, a reed switch 110 is provided on the scanner 40 of the optical system 3 so as to detect the magnets 101*a* and 102*a* for applying signals thereby to a control device CPU of FIG. 10.

In FIG. 8, reference numeral 60 denotes an operating panel. The operating panel 60 includes a print switch 61 and a simultaneous color switch 62.

Figure 11:
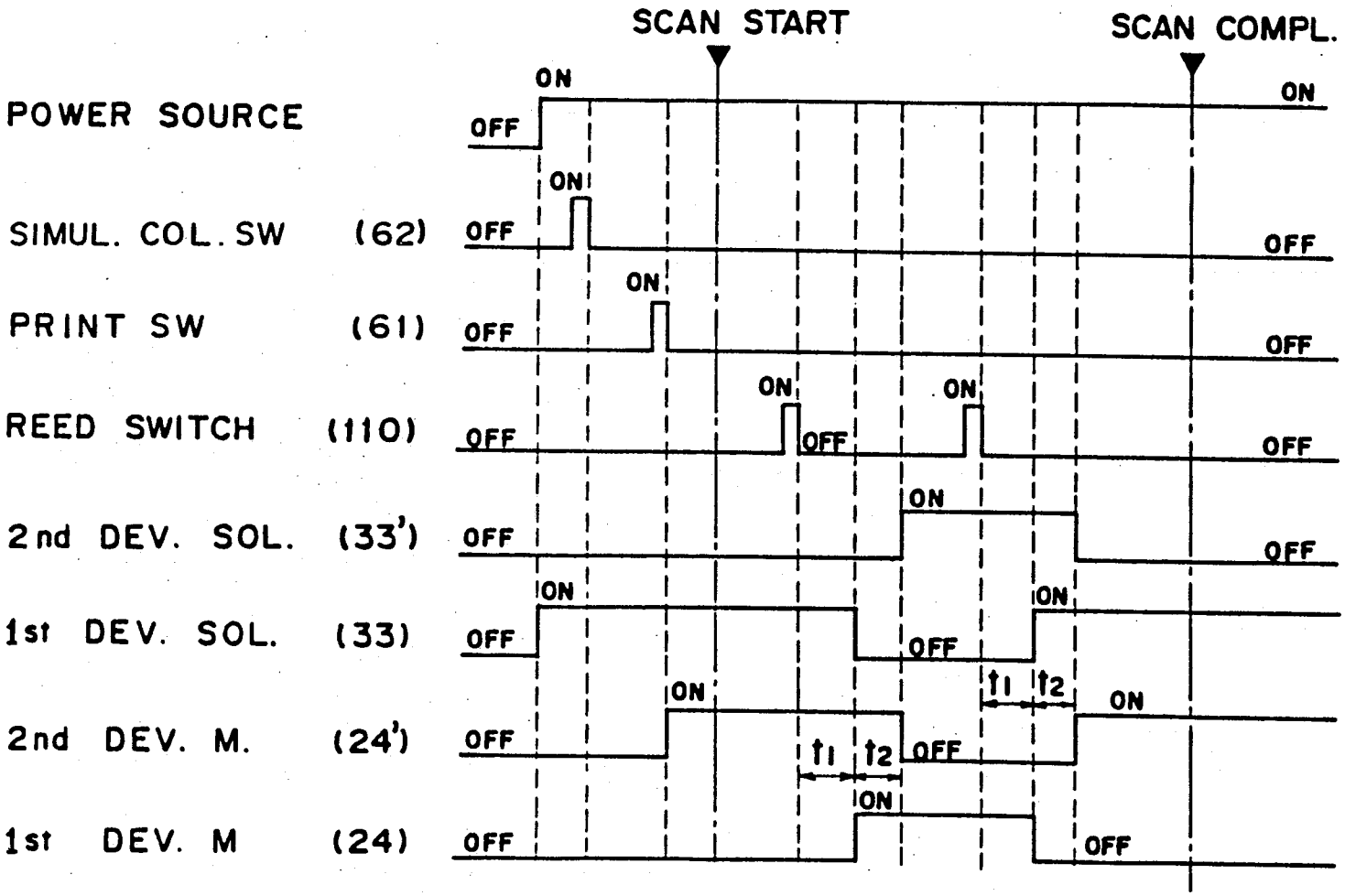
FIG. 11 is a timing chart showing control of the apparatus of FIG. 1.

Subsequently, control operations of the control device CPU of FIG. 10 in the case of simultaneous color copying will be described with reference to a timing chart of FIG. 11. It should be noted here that the numerals for the constituent elements of the second developing unit 5 are marked with "prime" (') for differentiation form those of the developing unit 4.

In the first place, when the power source is turned on through operation of a main switch MS of FIG. 10 for the copying apparatus, the intermediate portion between the magnetic poles N1 and S1 of the magnet roller 13 confronts the photosensitive surface 1*a* of the photoreceptor drum 1 in the first developing unit 4 as shown in FIG. 6, while the magnetic pole N1 faces said surface 1*a* in the second developing unit 5 as illustrated in FIG. 4.

Upon turning on of the print switch 61 in the above state, the second developing unit 5 containing the black toner is automatically driven for effecting the standard copying function, and when the simultaneous color switch 62 is turned on, the setting is so made that the simultaneous color copying can be effected. It is to be noted, however, that even if this simultaneous color switch 62 is depressed during the copying operation, the simultaneous color copying is not carried out.

When the simultaneous color switch 62 is turned on, the copying mode is altered from the ordinary copying to the simultaneous color copying mode.

In the above state, the regions A and C for effecting the white and black copying, and the region B for effecting the color copying are designated as shown in FIG. 8 by sliding the first and second levers 101 and 102 along the sliding groove 103.

It should be noted here that the levers 101 and 102 are effective only when the simultaneous color copying is selected, and arranged not to function at all, even if operated at a time other than above.

Under the state set as described so far, when the print switch 61 is turned on, with an original document S placed on the original document platform 9 as shown in FIG. 8, a developing motor 24' for the second developing unit 5 is started, and the developing sleeve 12', supply roller 14' and screw 15' are respectively rotated in the directions indicated by the arrows b, c and d.

Accordingly, the developer containing the black toner and accommodated in the developing tank 11' is circulated for transportation through the transport passages 16' and 17', while being mixed and stirred based on the rotation of the supply roller 14' and screw 15', and part of the developer is supplied onto the surface of the developing sleeve 12' by the supply roller 14' so as to form the magnetic brush of the developer on said developing sleeve.

The magnetic brush thus formed passes through the brush bristle height restricting gap Db as it is cut off by the bristle height restricting member 19' based on the rotation of the developing sleeve 12' so as to be successively fed out onto the developing region X' for establishing the state capable of developing the electrostatic latent image formed on the photosensitive surface 1*a* of the photoreceptor drum 1.

Meanwhile, based on the turning on of the print switch 61, the scanner 40 starts functioning in the direction of the arrow m so as to project light onto an original document S placed on the original document platform 9, and the light reflected therefrom is projected onto the photosensitive surface 1*a* of the photoreceptor drum 1 at the exposure point W so as to form the electrostatic latent image of the original document on said surface 1*a*. The latent image thus formed is first developed by the second developing unit 5.

Subsequently, when the magnet 101*a* of the first lever 101 is detected by the reed switch 110 of the scanner 40, said reed switch 110 applies its signal to the control device CPU of FIG. 10.

It is to be noted here that at this time point, the latent image corresponding to a boundary portion Z1 between the regions A and B where change-over is effected from the black to color, is located at the exposure point W on the photosensitive surface 1*a* of the photoreceptor drum 1, and during the time period (t1=0.22 sec) in which the boundary portion Z1 is displaced from the position of the exposure point W up to the developing region X of the first developing unit 4, only the second developing unit 5 is successively operated.

After a time period t1 from the turning on of the reed switch 110, when the boundary portion Z1 of the electrostatic latent image reaches the developing region X, the first developing motor 24 is turned on, while the first developing solenoid 33 is turned off. By the above operation, the first developing unit 4 is set in the state as shown in FIGS. 4 and 5 in the similar manner as in the second developing unit 5, with the developing sleeve 12, supply roller 14 and screw 15 being respectively rotated in the direction indicated by the arrows b, c and d, and the magnetic brush is formed on the surface of the developing sleeve 12, thereby establishing the state capable of developing the latent image on the surface 1*a* of the photoreceptor drum 1. Thus, at the first developing unit 4, function to supply the color toner to the latent image corresponding to the region B is started.

Then, after a time period t2 from the starting of the first developing motor 24, i.e., after the time (t=0.2 sec.) required for the boundary portion Z1 of the latent image to move from the developing region X to the developing region X' for the second developing unit 5, the motor 24' of the second developing unit 5 is turned off, while the second developing unit solenoid 33' is turned on. By the above functions, the second developing unit 5 is set in the state as shown in FIGS. 6 and 7, and the intermediate portion between the magnetic poles N1 and S1 confronts the surface 1*a* of the photoreceptor drum 1, with the developing sleeve 12, supply roller 14 and screw 15 stopping rotation, and thus, the developing function for the region A by the black toner is terminated.

When the scanner 40 is further displaced, and reaches the position of the second lever 102, i.e., the boundary portion Z2 between the regions B and C, the reed switch 110 detects the magnet 102*a* so as to be again turned on for outputting the signal to the control device CPU. It is to be noted here that at this time, the electrostatic latent image corresponding to the boundary portion Z2 is located at the exposure point W.

After a time period t1 from the turning on of the reed switch 110, i.e., when the electrostatic latent image at the boundary portion Z2 reaches the developing region X, the first developing motor 24 is turned off, with the turning on of the first developing solenoid 33, and thus, color developing for the region B is terminated.

Further, after the time period t2, i.e., when the boundary portion Z2 of the electrostatic latent image located at the developing region X reaches the developing region X' of the second developing unit 5, the second developing motor 24' is turned on, while the second developing solenoid 33' is turned off, and the black development for the region C is started.

The above function is maintained up to the termination of the scanning, and thus, the development for the region C is completed.

By the above operation, during the period from the starting of the scanning up to the completion thereof, two-color composite copy, in which the developing color is changed over from black to color, and further, to black, is obtained.

It is to be noted here that, in the above embodiment, although it is so arranged that the developing color is changed over in the order from black to color, and further, to black, the coloring pattern is not limited to the above, but the image editing pattern can be altered in any way, for example, by increasing the number of levers or changing the order of the developing units to be used for the starting of the development.

Moreover, in the foregoing embodiment, although the case where the two-color print is to be obtained by providing the two developing units 4 and 5 around the photoreceptor drum 1 has been described, the arrangement is not limited to the above, but may be, for example, so modified to provide three or four developing units around the photoreceptor drum 1, thereby to obtain color prints in three or four colors.

Furthermore, in the foregoing embodiment, although the arrangement is so made that, during the non-developing period, the developing motor 24 is stopped, with the magnet roller 13 rotated so as to retreat the magnetic pole from the developing region X for displacement thereof to the portion confronting the bristle height restricting member 19, the magnetic pole need not necessarily be displaced as in the above embodiment between the developing period and the non-developing period. However, if it is arranged as in the embodiment, the possibility in which the magnetic brush contacts the photoreceptor drum 1 is reduced to prevent the mixing in colors.

Similarly, the arrangement for subjecting the exposure lamp 41 to scanning function, with the original document platform 9 fixed in the foregoing embodiment, may be modified so that the original document platform 9 is caused to scan, with the exposure lamp 41 held stationary.

As is clear from the foregoing description, in the copying apparatus according to the present invention, there is provided the image editing mechanism for designating the regions by dividing the original document placing surface of the original document platform in the scanning direction, and the multi-color composite copy is obtained during a single scanning operation by reproducing the regions as designated by the image editing mechanism in specific colors respectively.

Therefore, since it is not required to effect the copying operations by the number of reproducing colors as in the arrangements having conventional multi-color image editing function, there is no possibility of giving rise to deterioration in image quality, for example, due to mixing of colors through overlapping at the boundary portions by faulty resist or thermal shrinkage of the copy paper sheets, or due to discontinuity of the image by blank portions at the boundary portions, and thus, multi-color images at high quality can be obtained.

Furthermore, since the multi-color image can be obtained by one single image forming process, a special mechanism for recycling the copy paper sheets can be deleted, so that the image forming apparatus can be made compact in size.

Moreover, since the above operation can be effected by one scanning operation, time required for the copying may be advantageously reduced.

Figure 12:
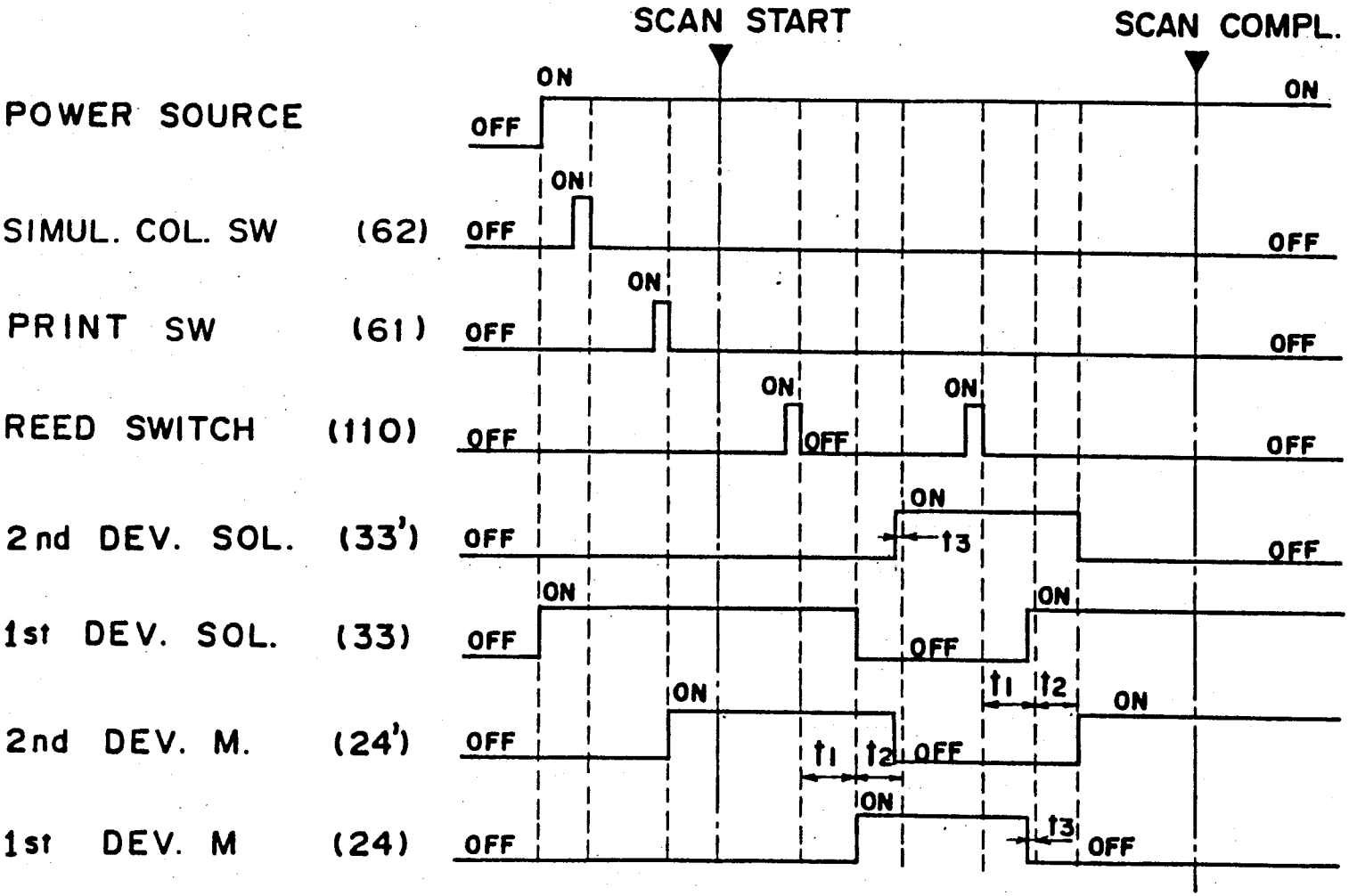
FIG. 12 is a view similar to FIG. 11, particularly showing one example of changeover of the developing units of FIG. 2.
Figure 13:
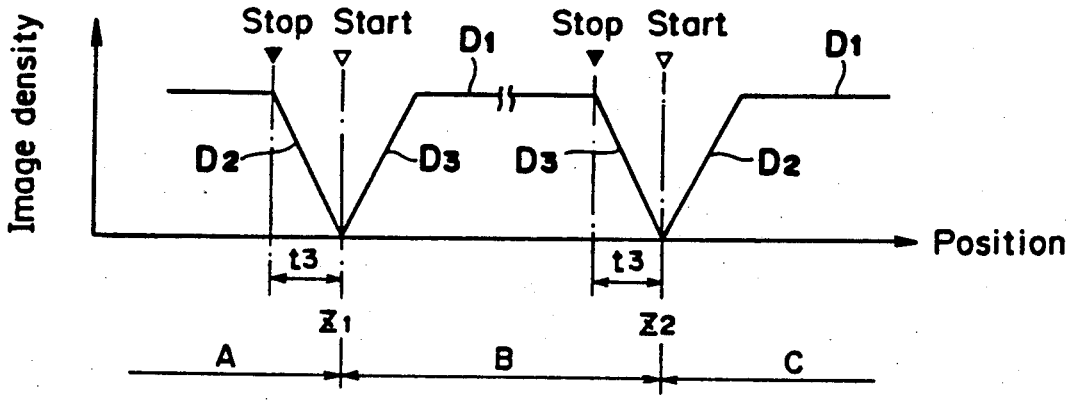
FIG. 13 is a graph indicative of change of image density in the example of FIG. 12.
Figure 14:
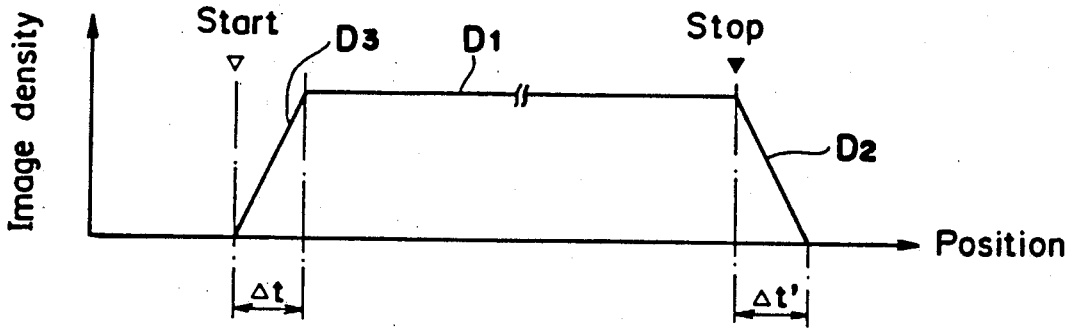
FIG. 14 is a graph indicative of developing characteristics of the developing units in the example of FIG. 12.

FIGS. 12 to 14 show one example of changeover of the first and second developing units 4 and 5. Referring to FIG. 12, in the electrostatic latent image disposed in the developing region X at the time of starting of the first developing unit 4, a portion of the latent image, which is located at the upstream side in the rotational direction of the photoreceptor drum 1, and another portion of the latent image, which is located at the downstream side in the rotational direction of the photoreceptor drum 1, are different, in time period of their contact with the magnetic brush, from each other. Thus, as shown in FIG. 13, image density at a forward end of the region B changes gradually to a stable state D1 from a developing rise region D3.

Then, after the time period t2 from starting of the first developing motor 24, i.e. after the time t of 0.2 sec., the boundary portion Z1 of the latent image moves from the developing region X to the developing region X' of the second developing unit 5.

However, at a point preceding the point by a time period t3, the second developing unit 5 changes over the operational state of the developing motor 24' and the solenoid 33' to the non-developing state as shown in FIGS. 6 and 7. Thus, the intermediate portion between the magnetic poles N1 and S1 confronts the surface 1*a* of the photoreceptor drum 1 and rotation of the developing sleeve 12', the supply roller 14' and the screw 15' is stopped, so that development of the region A by the black toner is terminated.

Meanwhile, as shown in FIG. 14, the above described time period t3 is set to a value substantially identical with a developing rise time period $\Delta t$ or a developing fall time period $\Delta t'$ and is concretely set to 50 msec. Therefore, as shown in FIG. 13, at the time when the boundary portion Z1 has passed through the developing region X', development by the second developing unit 5 is terminated completely via a developing fall region D2. Since the image density has assumed zero, mixing of the colors due to overlapping supply of the developers of the different colors to a portion adjacent to the boundary portion Z1 does not take place.

After the time period t1 from turning on of the reed switch 110, the electrostatic latent image at the boundary portion Z2 reaches the developing region X.

However, at a point preceding the point by the time period t3, the first developing unit 4 changes over the operational state to the non-developing state as shown in FIGS. 6 and 7 and thus, development of the region B by the color toner is terminated. Therefore, as shown in FIG. 13, at the time when the boundary portion Z2 has passed through the developing region X, development by the first developing unit 4 is terminated completely via a developing fall region D3 and the image density has assumed zero. Thereafter, in the developing region X', even if development of the region C is started from the boundary portion Z2 by the second developing unit 5, mixing of the colors due to overlapping supply of the black image and the color image to an identical portion does not take place.

Subsequently, after a time period of (t1+t2) from turning on of the reed switch 110, namely, when the boundary portion Z2 of the electrostatic latent image disposed at the developing region X has reached the developing region X' of the second developing unit 5, the motor 24' and the solenoid 33' of the second developing unit 5 are turned on and off, respectively and thus, black development of the region C is started.

Meanwhile, at this time, in the same manner as in development of the forward end of the region B by the first developing unit 4, portions of the electrostatic latent image, which are, respectively, located at the upstream side and the downstream side of the developing region X' at the time of starting of the second developing unit 5, are different, in time period of their contact with the magnetic brush, from each other. Therefore, the image density of the region C by the black toner gradually changes to the stable state D1 from the developing rise region D2 without sharp rise.

Meanwhile, in this example, timing of completion of development in the boundary portions of the regions is advanced by the predetermined time period t3 and timing of start of development is started from the boundary portions Z1 and Z2. However, on the contrary, it can also be so arranged that timing of completion of development is terminated at the boundary portions and timing of start of development is delayed by the predetermined time period t3 such that mixing of the colors between the neighboring regions is prevented.

Furthermore, in this example, the predetermined time period t3 is set to a value substantially identical with the developing rise time period $\Delta t$ or the developing fall time period $\Delta t'$ such that mixing of the colors at the boundary portions Z1 and Z2 is prevented. However, if the developing operation of the developing unit for developing the region following the boundary portions is started after development of the region preceding the boundary portions, the time period t3 may be set to be shorter than the developing rise time period $\Delta t$ or the developing fall time period $\Delta t'$. In this case, mixing of the colors occurs slightly at the boundary portions.

However, since the image density in the developing rise region and the developing fall region becomes higher than the image density of the region in which mixing of the colors takes place, the slight mixing of the colors does not pose a problem visually.

As will be seen from the foregoing, in this example, a plurality of the developing units containing the developers of different colors are provided around the electrostatic latent image support member and the developers are, respectively, supplied during a single scanning operation from the developing units to the regions divided preliminarily in the scanning direction of the optical system and timing of starting development of the boundary portions is delayed or timing of terminating development of the boundary portions is advanced.

Therefore, in the example, it becomes possible to obtain an image of high quality free from or substantially free from mixing of the colors at the boundary portions between the neighboring regions.

Figure 16:
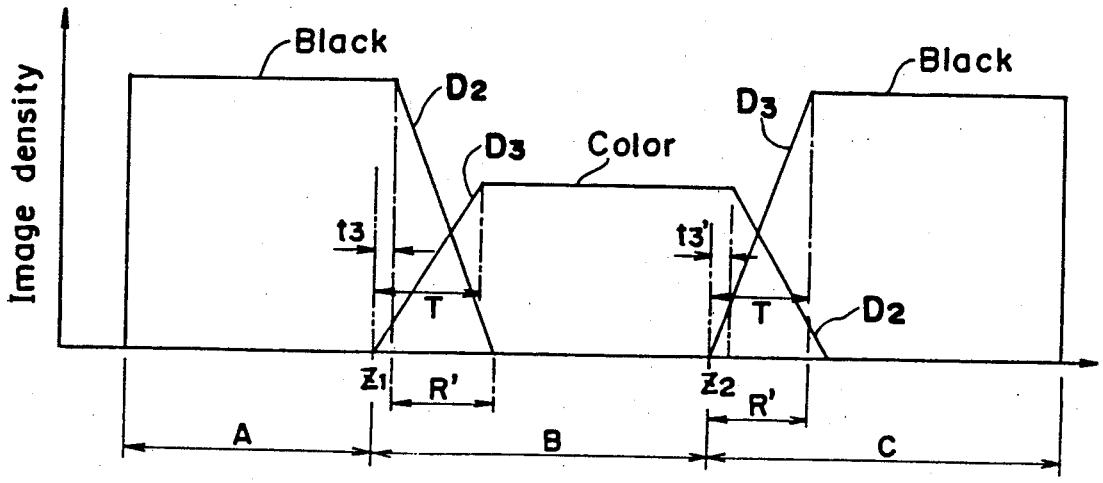
FIGS. 15 and 16 are views similar to FIGS. 12 and 13, respectively, particularly showing a further example of changeover of the developing units of FIG. 2.
Figure 15:
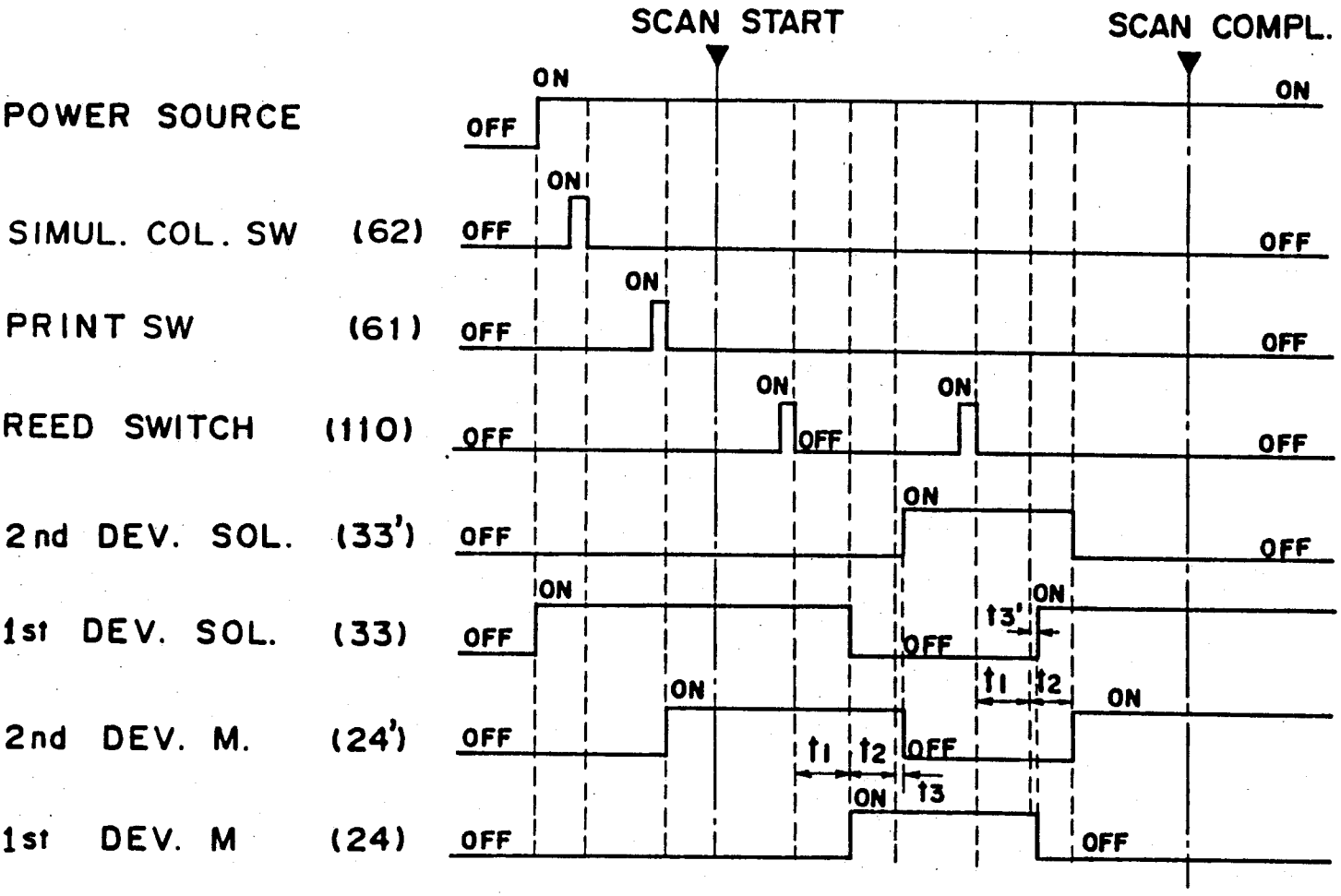

FIGS. 15 and 16 show a further example of change-over of the first and second developing units 4 and 5. As shown in FIG. 16, since the forward end of the latent image and a portion of the latent image immediately following the forward end proceed to the developer at the developing region X' after the second developing unit 5 has been put into full operation, the image density rises sharply.

After the time period t2 from starting of the first developing motor 24, the developing motor 24' and the solenoid 33' of the second developing unit 5 do not change their operational state and, with delay of a time period t3, are set to the state shown in FIGS. 6 and 7. At this time, since the electrostatic latent image on the photoreceptor drum 1 is brought into contact with the developer through a certain width, the image density gradually drops via the developing fall region D2 without sharp drop as shown in FIG. 16.

Meanwhile, as shown in FIG. 16, the above described time period t3 is properly set to a value in the range of a developing rise time period T during which the density of the toner image formed on the photoreceptor drum 1 becomes stable after starting of the first developing unit 4. Therefore, in the vicinity of the boundary portion Z1, mixing of the colors takes place through overlap of the black image and the color image. However, a visual width R' of mixing of the colors is restricted to the developing fall region D2 of the black image having a high density and a portion adjacent to the boundary portion Z1 is reproduced completely.

After the time period t1 from turning on of the reed switch 110, the electrostatic latent image at the boundary portion Z2 reaches the developing region X.

However, at this time, the developing motor 24 and the solenoid 33 of the first developing unit 4 do not change their operational state and, with delay of a time period t3', not only the developing motor 24 is turned off but the solenoid 33 is turned on, thereby resulting in termination of the color development of the region B. Meanwhile, the time period t3' is properly set to a value in the range of the developing rise time period T during which the density of the image formed on the photoreceptor drum 1 by the second developing unit 5 becomes stable after starting of the second developing unit 5. The time period t3' is set to be identical with the time period t3.

Thus, as shown in FIG. 16, during the time period t3' following the boundary portion Z2, development by the color toner is performed and then, the image density decreases via the developing fall region D2.

In the same manner as the portion adjacent to the boundary portion Z1, mixing of the colors takes place through overlap of the black image and the color image in the vicinity of the boundary portion Z2. However, the visual width R' of mixing of the colors is restricted to the developing rise region D2 of the black image having a high density and a portion adjacent to the boundary portion Z2 is reproduced completely.

In this further example, timing of completion of development in the boundary regions is delayed by the predetermined time period t3 or t3' with respect to timing of passing of the boundary portions through the developing position. However, on the contrary, it can also be so arranged that timing of start of development is advanced by the time period t3 or t3' with respect to timing of passing of the boundary portions through the developing position.

As will be apparent from the description given so far, in the further example, supply of the developer of the developing unit for developing the region preceding the boundary portions is stopped during the developing rise time period of the developing unit for developing the region following the boundary portions.

Accordingly, in the further example, shear of the images at the boundary portions is eliminated and the original document can be reproduced completely by minimizing the width of mixing of the colors without missing of the image at the boundary portions.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A multi-color image forming apparatus comprising:

an original platform;

a photoreceptor;

a scanning means for scanning from a scanning start position towards a scanning completion position an original document placed on said original platform;

a designating means which is movable, in a direction of scanning of said scanning means along said original platform, at least between the scanning start position and the scanning completion position;

an image forming means which projects an image of the original document scanned by said scanning means, onto said photoreceptor so as to form a singular electrostatic latent image corresponding to the original document on said photoreceptor irrespective of the position of said designating means;

first and second developing means for developing the electrostatic latent image in first and second colors, respectively;

an input means for giving a command for starting copying of said multi-color image forming apparatus;

a starting means for starting operation of said scanning means, said image forming means and said first developing means in response to the command from said input means;

detecting means which detects that said scanning means has reached, during scanning by said scanning means, a position corresponding to said designating means;

first timer means responsive to said detecting means for starting a time count operation of a first predetermined time;

second timer means responsive to said detecting means for starting a time count operation of a second predetermined time; and a first control means for stopping operation of said first developing means in response to the completion of time counting operation of said first timer means;

a second control means for starting operation of said second developing means in response to the completion of time counting operation of said second timer means;

whereby said singular electrostatic latent image is developed with first and second colors using a single scan of said scanning means.

2. A multi-color image forming apparatus as claimed in claim 1, wherein said second control means starts operation of said second developing means after operation of said first developing means has been stopped substantially completely by first control means.

3. A multi-color image forming apparatus as claimed in claim 1, wherein said first control means outputs a stop signal for stopping operation of said first developing means and a said second control means outputs a start signal for starting operation of said second developing means.

4. A multi-color image forming apparatus as claimed in claim 3, wherein operation of said first developing means is stopped through gradual drop of its developing capability in response to the stop signal and said second developing means assumes a predetermined developing capability through gradual rise of its developing capability in response to the start signal.

5. A multi-color image forming apparatus as claimed in claim 4, wherein said second control means outputs the start signal after operation of said first developing means has been stopped.

6. A multi-color image forming apparatus as claimed in claim 4, wherein said first control means outputs the stop signal and said second control means outputs the start signal such that operation of said first developing means is stopped before said second developing means assumes the predetermined developing capability.

7. A multi-color image forming apparatus as claimed in claim 4, wherein said first control mans outputs the stop signal and said second control means outputs the start signal so as to provide a time period during which said first developing means and said second developing means are operated simultaneously.

8. A copying apparatus comprising:

an original platform;

a movable scanning means for scanning an original document placed on said original platform;

means for projecting the scanned image onto a photosensitive member and forming a singular electrostatic latent image thereon;

first and second developing means which contain toners of different colors, respectively, for developing the latent image;

a designating means which is movable along said original platform;

a detecting means for detecting that said scanning means has reached a position designated by said designating means;

first timer means responsible to said detecting means for starting a time count operation of a first predetermined time;

second timer means responsive to said detecting means for starting a time count operation of a second predetermined time;

an input means for giving a command for starting copying by said copying apparatus;

a start control means for starting operation of said first developing means in response to the command from said input means;

a first control means for stopping operation of said first developing means in response to the completion of time counting operation of said first timer means; and a second control means for starting operation of said second developing means in response to the completion of time counting operation of said second timer means;

whereby said singular electrostatic latent image is developed with first and second colors using a single scan of said scanning means.

9. In a multi-color image forming apparatus including a photosensitive member, means movable along a scanning path for scanning an original and projecting the scanned image onto the photosensitive member to form a latent image corresponding to the original, first developing means for developing the latent image with a first color developer and a second developing means for developing the latent image with a second color developer, the method of forming a multi-color image comprising the steps of:

designating a desired position in a scanning path;

scanning the original and projecting the scanned image on the photosensitive member to form a single latent image corresponding to the original;

developing the single latent image being formed with the first color developer;

generating a changeover signal corresponding to said desired position while forming the single latent image; and stopping the developing operation with the first color developer after a first time from the generation of the changeover signal; and initiating the developing operation with the second color developer after a second time from the generation of the changeover signal, whereby the single latent image is developed with two color developers.

10. A copying apparatus comprising:

an original platform;

a movable scanning means for scanning an original document placed on said original platform;

means for projecting the scanned image onto a photosensitive member and forming a singular electrostatic latent image thereon;

first and second developing means which contain toners of different colors, respectively, for developing the latent image;

first designating means which is movable along said original platform;

second designating means which is movable along said original platform independent of said first designating means;

a signal generating means for generating a first signal when said scanning means has reached a first position designated by said first designating means and for generating a second signal when said scanning means has reached a second position designated by said second designating means;

first timer means responsive to said first signal for starting a time count operation of a first predetermined time;

second timer means responsive to said first signal for starting a time count operations of a second predetermined time;

third timer means responsible to said second signal for starting a time count operation of a third predetermined time;

fourth timer means responsive to said second signal for starting a time count operation of a fourth predetermined time;

an input means for giving a command for starting copying of copying apparatus;

a start control means for starting operation of said first developing means in response to the command from said input means;

a first control means for stopping operation of said first developing means in response to the completion of time counting operation of said first timer means;

a second control means for starting operation of said second developing means in response to the completion of time counting operation of said second timer means;

a third control means for starting operation of said first developing means in response to the completion of time counting operation of said third timer means;

a fourth control means for starting operation of said second developing means in response to the completion of time counting operation of said fourth timer means;

whereby said singular electrostatic latent image is developed with first and second colors using a single scan of said scanning means.

* * * * *